United States Patent [19]

Weisman

[11] 3,956,857

[45] May 18, 1976

[54] ICE SKATE BLADE SHARPENING MACHINE

[76] Inventor: Charles Weisman, 125 N. Montgomery St., Valley Stream, N.Y. 11580

[22] Filed: Nov. 29, 1974

[21] Appl. No.: 528,232

Related U.S. Application Data

[63] Continuation of Ser. No. 352,891, April 20, 1973, abandoned.

[52] U.S. Cl. ..... 51/141

[51] Int. Cl.[2] ..... B24B 21/16

[58] Field of Search..... 51/135 R, 135 BT, 141, 51/210, 240 R, 395, 398, 402, 405; 76/83

[56] References Cited

UNITED STATES PATENTS

| | | | |
|---|---|---|---|
| 1,191,045 | 7/1916 | Verwer | 51/135 R X |
| 2,363,728 | 11/1944 | Grunwald | 51/141 X |
| 2,624,158 | 1/1953 | Hendrickson | 51/141 |
| 2,723,506 | 11/1955 | Paynton | 51/141 |
| 3,570,190 | 3/1971 | Rutt et al. | 51/141 |
| 3,650,073 | 3/1972 | Weisman | 51/141 |

FOREIGN PATENTS OR APPLICATIONS

| | | | |
|---|---|---|---|
| 264,624 | 1/1927 | United Kingdom | 51/395 |

*Primary Examiner*—Al Lawrence Smith
*Assistant Examiner*—Nicholas P. Godici
*Attorney, Agent, or Firm*—Bauer, Amer & King

[57] ABSTRACT

For sharpening an ice skate blade or the like, apparatus is provided including a substantially flat reference surface relative to which is mounted a frame that supports a drive motor. A flexible, endless abrasive coated belt is trained about a pulley system that is coupled to and is driven by the output shaft of the drive motor. A convex, movable platen and hold down means cooperating therewith are provided for shaping the belt to the platen. Means are provided for fixing the longitudinal centerline of the platen with respect to the reference surface. On one embodiment of the invention where the platen is movable the last mentioned means provide for moving the platen only in a plane substantially parallel to the plane of the reference surface and for preventing vertical displacement of the platen. The article to be sharpened is held in a suitable jig and clamp arrangement that is positioned on the reference surface whereby the article may be brought into engagement with the abrasive portion of the belt.

The aforementioned Abstract is neither intended to define the invention of the application which, of course, is measured by the claims, nor is it intended to be limiting as to the scope of the invention in any way.

3 Claims, 5 Drawing Figures

ICE SKATE BLADE SHARPENING MACHINE

CROSS-REFERENCE TO RELATED APPLICATIONS

This is a continuation of application Ser. No. 352,891 filed Apr. 20, 1973, now abandoned.

BACKGROUND OF THE INVENTION

This invention relates generally to grinding machines and more particularly to a grinding machine for precisely sharpening an ice skate blade.

DESCRIPTION OF THE PRIOR ART

In order to achieve maximum efficiency in the use of ice skates, the blades must be accurately sharpened so as to provide a concave surface along the bottom surface. The concave portion of the blade runs through the length thereof and must be defined by sharp longitudinal edges that are in a common plane as near to perpendicular to the side edges of the blade as is possible. Furthermore, a generous radius is usually provided from the sole to the heel portions of the blade and, in the case of a figure blade, at least one toe tooth is also provided. A properly sharpened blade not only permits the skates to be used with maximum efficiency but also makes skating easier, thus adding to the enjoyment of skating for amateurs, and professionals. Needless to say, professional skaters must maintain their blades at peak quality. However, in spite of the inherent hardness of the blade material, they often become dulled with even limited use and require frequent resharpening.

Ice skate blades, can of course, be sharpened by hand. However, it is virtually impossible to manually sharpen figure ice skate blades accurately regardless of the care and skill that are exercised. For this reason attempts have been made to develop machines that will perform the blade sharpening task accurately. While the prior art machines that are presently available represent a substantial improvement over the hand operations, it has long been recognized that the prior art machines still leave much to be desired as far as the accuracy of the sharpening and the convenience of the operation are concerned. Generally speaking, the prior art machines use grinding stones that are susceptible to wear. Because of the expense of the stones, generally only a stone of one grit size is used even though different steels require different grits. While a stone can be dressed to restore it approximately to its original shape, this too is a burdensome job that requires considerable skill in order to be done properly and tends to quickly wear down the stone. The use of a high speed grinding stone requires considerable experience and even a skilled operator can improperly sharpen ice skate blades if he uses uneven pressure or if he does not manipulate the ice skate blade uniformly against the stone as it traverses the length of the blade.

One example of the grinding stone type of prior art machine is disclosed in U.S. Pat. No. 1,487,142 issued on Mar. 8, 1924, to V. A. Boker. This patent features the use of a clamp for rigidly securing a pair of ice skate blades in parallel relationship to each other. The clamp is also provided with means for retaining a guide plate which is positioned against an arcuate guide that is located between a pair of rotatable grinding stones. When the stones are driven by a motor, the operator rocks the guide plate against the guide so that the ice skate blades are abraided by the stones. It is apparent that the success of the sharpening operation depends upon the skill and manual dexterity of the operator. Moreover, in the issued patent just described, the grinding stones must be frequently dressed to maintain them in their best condition.

Another somewhat more pertinent example of the prior art is disclosed in my issued U.S. Pat. No. 3,650,073 granted on Mar. 21, 1972. My issued patent teaches the use of a pair of endless abrasive belts that are supported by vertically adjustable platens and which are driven by a pair of tandem pulleys that are both mounted on the output shaft of a motor. It should be specifically noted at this time that the platens in my aforementioned issued patent are vertically adjustable with respect to a reference member whose height is variable and not to an accurately formed, fixed reference surface that is not movable and which will be described in detail hereinafter.

The structure taught by my issued patent represents a substantial improvement over the art available prior thereto. However, I have found that still further refinements are possible to thereby achieve a greater degree of precision and to simplify the grinding procedure. For example, I found a greater accuracy and a superior finish is obtainable when only a single blade is sharpened at one time. Further, a potential source of error is eliminated by preventing vertical movement of the platen whereby the longitudinal centerline of the platen is fixed with respect to a reference surface that is accurately formed and, if desired, by limiting any movement of the platen to a plane substantially parallel to a plane of the accurately formed reference surface.

SUMMARY OF THE INVENTION

In one broad aspect, the present invention provides a convex platen having a longitudinal centerline that is accurately positioned at a predetermined height above a fixed, accurately formed reference surface. A flexible, abrasive coated belt is driven by a pulley system over the convex surface of the platen which is limited to movement only in a plane substantially parallel to the plane of the reference surface. The skate blade is held in a suitable jig and clamp arrangement, for example, such as disclosed in my copending application, Ser. No. 337,375 filed Mar. 2, 1973, now abandoned. The flexible coated belt is shaped to the contour of the convex platen by means of hinged plates and preferably is provided with two laterally or transversely spaced apart abrasive tracks. Means are provided for vertically adjusting the position of the abrasive belt relative to the reference surface. A ring stone may be incorporated in one of the pulleys of the system to provide means for deburring the longitudinal edges of the ice skate blade. The platen is readily interchangeable with other platens having different radii, and may be rigidly secured to a frame with the longitudinal axis of the platen precisely spaced from an accurate reference surface or, alternatively, any movement of the platen may be limited to a plane that is parallel to the reference surface.

Accordingly, it is an object of the present invention to provide an improved grinding machine for ice skate blades.

Another object of the present invention is to provide an improved machine for grinding a single ice skate blade.

Still another object of the present invention is to provide an improved grinding machine for ice skate blades wherein a flexible abrasive coated belt is driven by a pulley system over an adjustable platen the longitudinal axis of which is accurately located with respect to a reference surface.

Still another object of the present invention is to provide an improved grinding machine for ice skate blades having an attachment for deburring the longitudinal edges of the bottom surface of the blades.

A feature of the present invention is that the longitudinal centerline of the platen is limited to movement only in a plane parallel to the plane of the reference surface or fixed relative thereto and is readily interchangeable with other platens having different radii.

Another feature of the present invention is that the reference surface is reversible.

These and other objects, feature and advantages of the invention will, in part, be pointed out with particularity, and will, in part, become obvious from the following more detailed description of the invention, taken in conjunction with the accompanying drawing, which forms an integral part thereof.

BRIEF DESCRIPTION OF THE DRAWING

In the various figures of the drawing like reference characters designate like parts.

In the drawing.

DESCRIPTION OF THE PREFERRED EMBODIMENT

Figure 1:
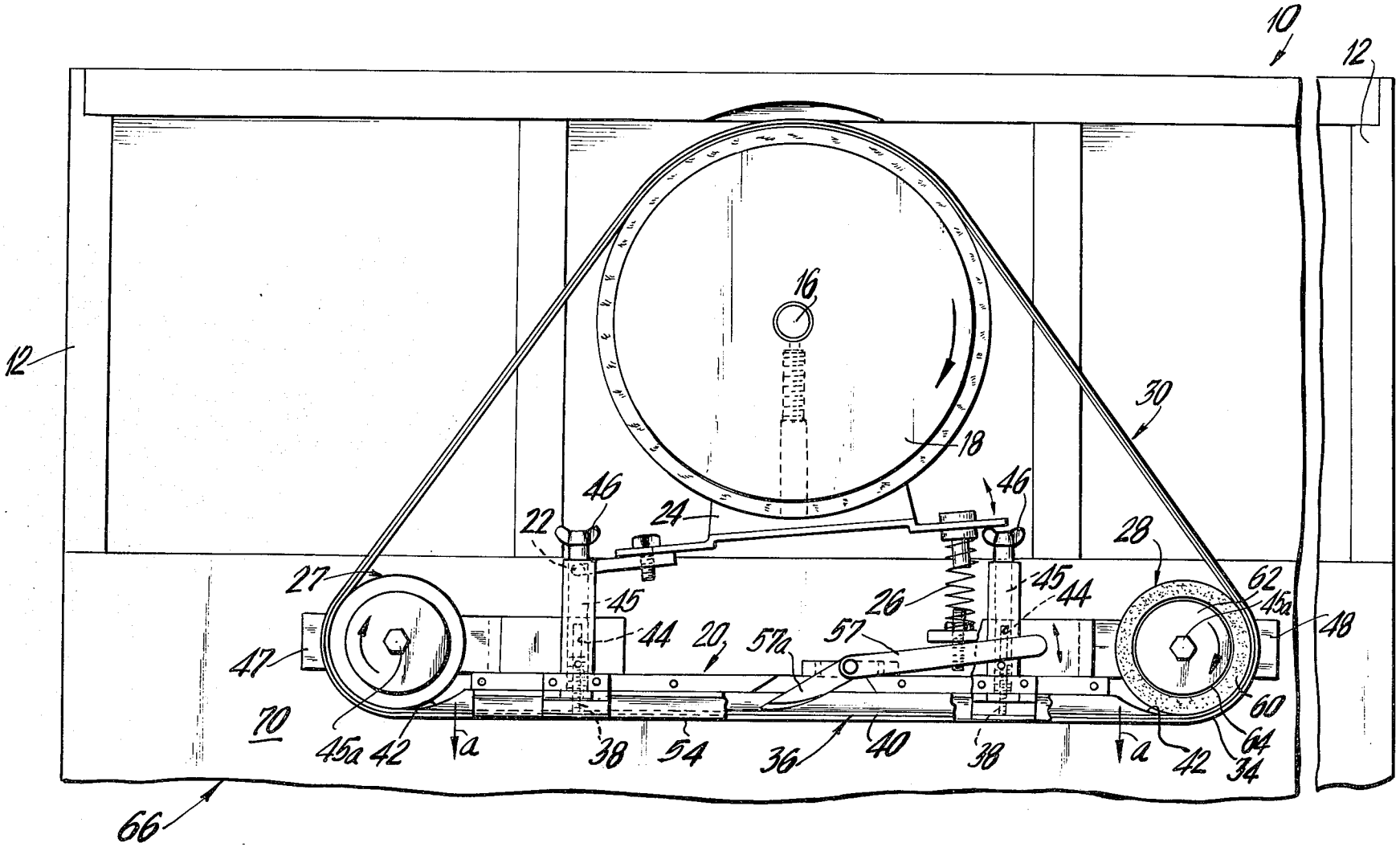
FIG. 1 is a top plan view of the grinding machine comprising the present invention.
Figure 2:
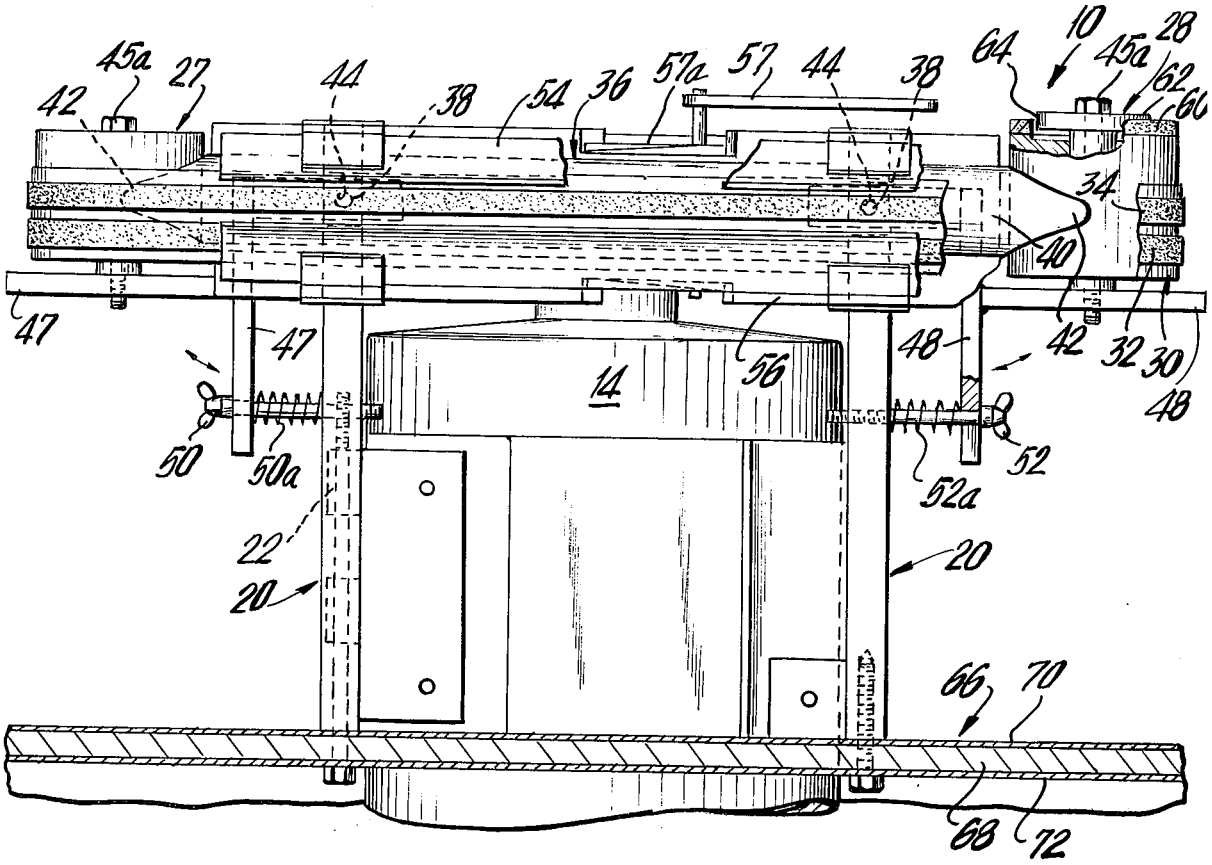
FIG. 2 is a front elevational view, partially broken away and partially in section, illustrating the improved grinding machine comprising the present invention.
Figure 4:
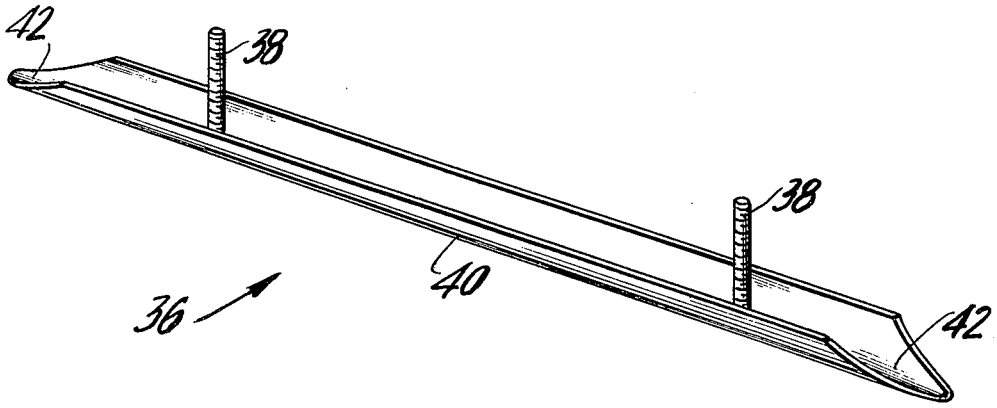
FIG. 4 is a perspective view partially broken away and partially in section showing the improved platen comprising this innvention.
Figure 3:
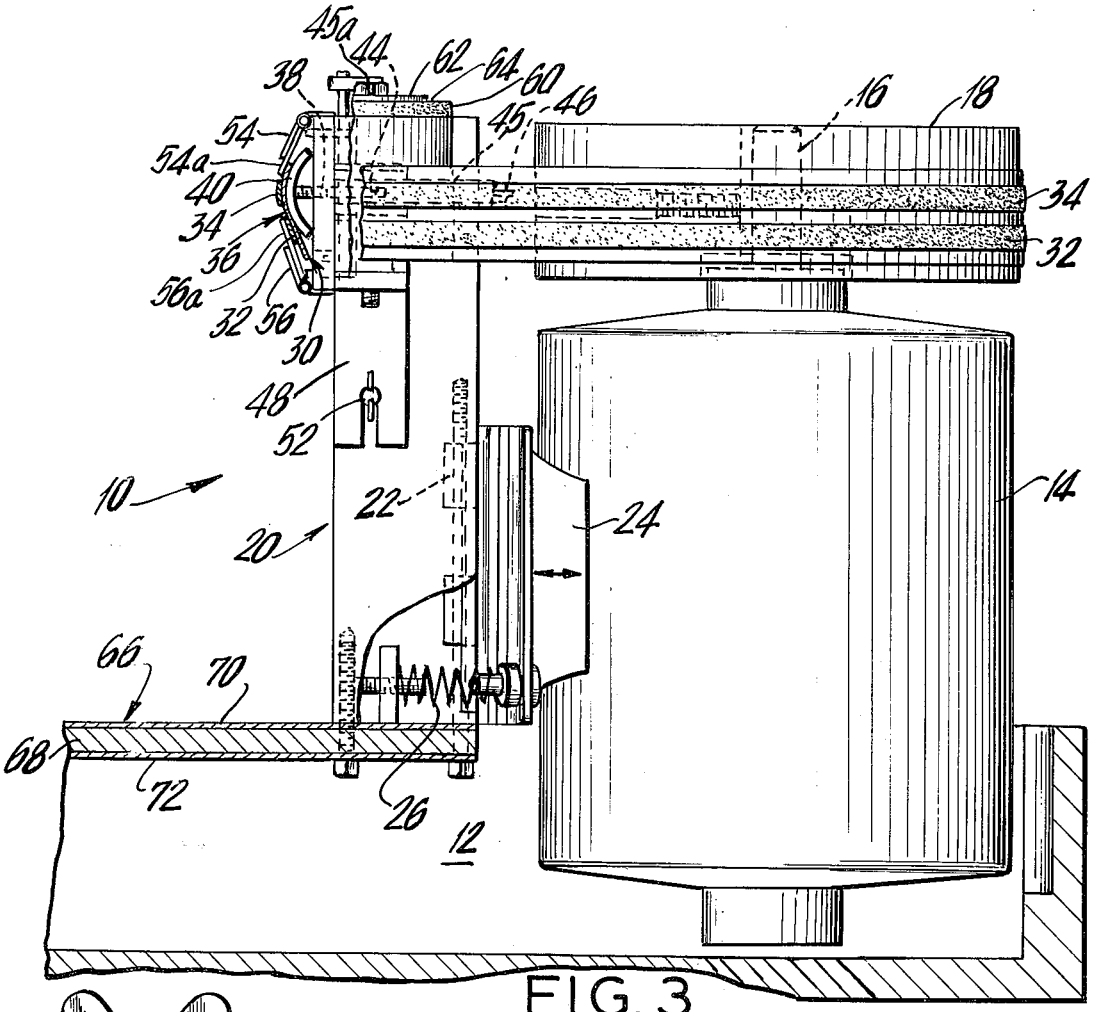
FIG. 3 is a fragmentary side elevational view partially broken away and partially in section illustrating the grinding machine shown in FIGS. 1 and 2.

Referring now to the drawing, there is shown in FIGS. 1, 2 and 3 the improved ice skate blade sharpening apparatus 10 comprising the present invention. The apparatus 10 includes a base member 12 above which is positioned a drive motor 14 having an output shaft 16 and a drive pulley 18 secured thereto. The base member 12 further includes an upright support frame 20 on which the drive motor 14 is hinged at 22 by means of a plate 24. Spring means 26 is used to normally bias the motor 14 in a counter clockwise direction (FIG. 1) about the hinge means 22. A pair of idler pulleys 27 and 28 are also suitably mounted on the upright 20 by means to be described hereinafter. A flexible endless belt, generally designated by the reference character 30, and including an integral pair of laterally spaced apart abrasive tracks 32 and 34 is trained about the pulleys 18, 27 and 28.

A platen generally designated by the reference character 36 is movably mounted on the upright 20 by means of serrated or threaded studs 38. The platen 36 includes an elongated convexly arcuate outer surface 40 in addition to arcuate end portions 42 that permit the positioning of the platen 36 in close proximity to the pulleys 27 and 28. The studs 38, which are integral with the rearward surface of the platen 36, are received and normally bottomed in accurately sized and located holes 44 formed in elongated, externally threaded shank portions 45 of winged bolts 46 that are threaded into the upright member 20. For purposes to be described hereinafter, the platen 36 may be moved in the direction shown by the arrows *a* in FIG. 1 by turning the wing nuts 46 to thereby advance the shank portions 45. To return the platen 36 to the position shown in FIG. 1 all that is needed is to back off the winged bolts 46 to their original position and push rearwardly on the platen 36.

As shown for example in FIG. 2, the width of the endless abrasive belt 30 is substantially less than the width of the pulleys 27 and 28. However, either one of the two abrasive tracks 32 or 34 must be aligned with the center line of the platen 36. To achieve this the pulleys 27 and 27 are journalled in pivotally mounted brackets 47 and 48, respectively, and are controlled by threaded studs 50 and 52 that hold the brackets 47 and 48 against the springs 50*a* and 52*a*. When the studs 50 and 52 are threaded inwardly or outwardly, the brackets 47 and 48 will pivot about axles 45*a* and the axes of the pulleys 27 and 28 will be displaced away from the vertical and will cause the belt to ride either upwardly or downwardly, as necessary. Since an abrasive belt with two such tracks 32 and 34 costs very little, if any, more than a comparable belt of the same width and length but with a single track, the provision of the two tracks 32 and 34, together with the adjustability of the pulleys, allows for a substantial cost savings since approximately twice the life of a given belt can be achieved and the rub bars 54*a* and 56*a* last longer because they touch between the abrasive tracks 32 and 34.

Turning now to FIG. 3, it will be seen that a pair of hingedly mounted hold down plates 54 and 56 along with their attached rub bars 54*a* and 56*a* are used to conform the flexible, abrasive belt 30 to the shape of the convex portion of the platen 36. The hold down plates 54 and 56 are spaced apart sufficiently so to expose only one of the two abrasive tracks 32 or 34. A lever 57 having a pair of vertically spaced apart fingers 57*a* is pivotally mounted on the upright 20 behind the hold down plates 54 and 56. The fingers 57*a* are used to displace and "open" the plates 54 and 56 so that the vertical position of the belt 30 may be varied or to permit the belt 30 to be changed.

Figure 5:
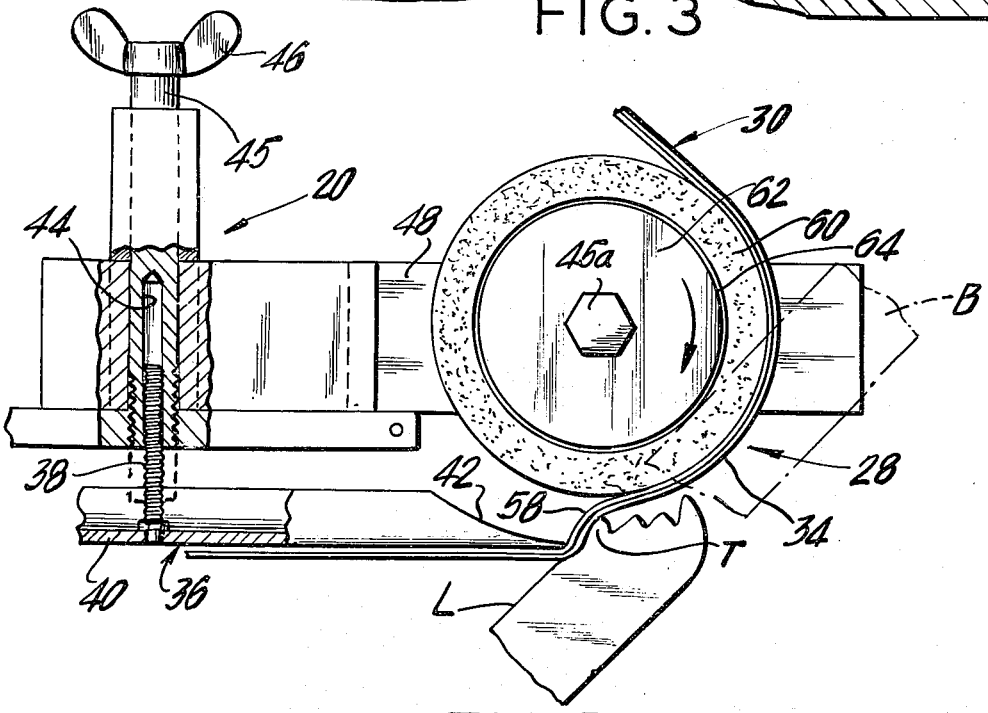
FIG. 5 is a fragmentary plan view illustrating several features of this invention.

As mentioned hereinabove, the platen 36 is prevented from moving vertically and moves only in a direction towards and away from the rotational axis of the pulley 18. One of the purposes of this arrangement is to provide for an intentional distortion of the belt 30 as shown for example in FIG. 5. When the platen 36 is spaced outwardly, as shown in FIG. 5, and the motor 14 is running, a hollow designated by the reference character 58 will be formed between the end of the platen 36 and the peripheral surface of the pulley 28. This hollow 58 permits the sharpening of the blade close to the toe tooth T shown in FIG. 5. Without the hollow 58 it would be quite likely that the pick tooth T would be damaged when the longitudinal surface L of the bottom of the blade B is sharpened in a normal manner.

FIG. 5 also illustrates another feature of the present invention. A ring stone 60 is secured to the top of the pulley 28 by any suitable means such as an adhesive. In addition, a disc 62 having a perpendicular, peripheral guide surface 64 is secured to the pulley 28 coaxially with the ring stone 60. After the longitudinal edge L of the blade B is sharpened, it is necessary to remove the burrs and this is done by holding the edge L of the blade B against the guide surface 64 of the disc 62 so that the sides of the blades B are abraided by the ring stone 60. This must be done by a fine grinding action which in the prior art was achieved by a hand stone. Where blades are deburred by a stone in the prior art, a shoulder very rapidly forms on the stone thus requiring constant replacing of the stone. By use of the ring stone 60 secured to the pulley 28 the length L of the blade B can rapidly be deburred using the proper grinding technique.

Another feature of the present invention is the provision of an improved reference surface generally designated by the reference character 66. The reference surface 66 is comprised of an aluminum plate 68 having a pair of oppositely facing hardened layers 70 and 72 formed thereon. A hard coating for example, an anodized layer, having a thickness of approximately 0.003 inch has been found to be suitable for this purpose. The reference surface 66 is removably secured to the base member 12 so that when either of the layers 70 or 72 are worn or damaged the reference surface 66 may be inverted and used again, and if necessary renewed. Of course a hard steel surface could also be used.

The present invention finds particular utility with my copending application discussed hereinabove. When a blade B is held in the clamps of the vertically adjustable jig described in my copending application the longitudinal center line of the blade will be precisely located in opposition to the center line of the platen 36 when the jig of my copending application is resting on either of the layers 70 or 72 of the reference surface 66. The jig may be moved along the reference surface 66 to bring the blade B into contact with one of the abrasive tracks 32 or 34 so that the blade B may be sharpened. Because of the absence of any vertical adjustment in the platen 36 and because of the accurate location of the center of the platen 36 with respect to the reference surface 66 by means of the studs 38 an accurate sharpening of the blade B is readily achieved.

From the foregoing it will be appreciated that an improved sharpening apparatus for ice skate blades has been provided. The accurate location of the center line of the platen with respect to the reference surface assures that the longitudinal center line of the blade will be coincidental with the longitudinal center line of the platen. Because the platen cannot be moved in a vertical direction, further accuracy than was heretofore available can be achieved. The double track, endless flexible belt provides greater economy than the belt in my previously mentioned patent, since it can be readily moved up and down merely by quickly adjusting the axes of the pulleys. The platen can be moved inwardly and outwardly in a plane parallel to the reference surface in order to provide a hollow at a specific location on the belt in order to permit the accurate sharpening of the blade at the pick tooth on a figure blade. The provision of a ring stone that cooperates with a disc as a blade guide permits rapid deburring of the skate blade after the longitudinal edge thereof has been sharpened.

There has been disclosed heretofore the best embodiment of the invention presently contemplated. However, it is to be understood that various changes and modifications may be made thereto without departing from the spirit of the invention.

What I claim as new and desire to secure by Letters Patent is:

1. Apparatus for sharpening an ice skate blade or the like, said apparatus comprising the combination of:

a. a support frame;

b. a substantially flat reference surface to which is secured said support frame;

c. a drive motor mounted on said support frame, said drive motor including an output shaft and a drive pulley secured thereto;

d. idler pulley means mounted on said support frame;

e. an endless, flexible abrasive coated belt trained about said drive pulley and said idler pulley means;

f. an elongated, convex platen mounted on said support frame behind said belt;

g. means to cause said belt to conform to the shape of said platen; and h. means rigidly secured to said support frame and coupled to said platen for limiting the movement of said platen to a plane that is substantially parallel to the plane of said reference surface, said means for limiting the movement of said platen being positioned at a non-changeable predetermined height above the plane of said reference surface whereby said platen is non-movable in a direction perpendicular to the plane of said reference surface, said means for limiting the movement of said platen comprising a pair of studs extending rearwardly therefrom and a pair of tubular members secured to said support frame for receiving said studs, the lontitudinal axes of said tubular members being at a predetermined dimension with respect to the plane of said reference surface, said tubular members being movable with respect to said support frame only in a direction parellel to the axes of said studs.

2. The apparatus in accordance with claim 1 wherein said studs are serrated.

3. The apparatus in accordance with claim 1 wherein said studs are threaded.

* * * * *